United States Patent [19]

Van Meurs et al.

[11] Patent Number: 4,667,739

[45] Date of Patent: May 26, 1987

[54] THERMAL DRAINAGE PROCESS FOR RECOVERING HOT WATER-SWOLLEN OIL FROM A THICK TAR SAND

[75] Inventors: Peter Van Meurs; Carlos A. Glandt, both of Houston, Tex.

[73] Assignee: Shell Oil Company, Houston, Tex.

[21] Appl. No.: 837,928

[22] Filed: Mar. 10, 1986

[51] Int. Cl.[4] ..... E21B 36/00; E21B 43/24; E21B 47/06

[52] U.S. Cl. ..... 166/250; 166/57; 166/64; 166/263; 166/302; 166/303

[58] Field of Search ..... 166/53, 64, 57, 250, 166/263, 272, 302, 303, 306

[56] References Cited

U.S. PATENT DOCUMENTS

| | | | |
|---|---|---|---|
| 2,148,717 | 2/1939 | Whitney | 166/267 X |
| 2,881,838 | 4/1959 | Morse et al. | 166/306 X |
| 2,940,395 | 6/1960 | Hill | 166/53 |
| 3,126,961 | 3/1964 | Craig, Jr. et al. | 166/306 X |
| 3,259,186 | 7/1966 | Dietz | 166/263 |
| 3,451,479 | 6/1969 | Parker | 166/303 |
| 3,882,941 | 5/1975 | Pelofsky | 166/303 |
| 3,993,135 | 11/1976 | Sperry et al. | 166/303 |
| 4,160,481 | 7/1979 | Turk et al. | 166/263 X |
| 4,265,310 | 5/1981 | Britton et al. | 166/302 X |
| 4,299,278 | 11/1981 | Beehler | 166/303 X |

*Primary Examiner*—George A. Suchfield

[57] ABSTRACT

Hot liquid-containing water-swollen tar is produced from a tar sand by injecting steam into a well, which is at least initially open and substantially free of obstruction to vertical fluid flow throughout a long vertical interval from the bottom of the tar sand, by producing said liquid from the bottom of the tar sand and maintaining injection and production flow rates that keep the steam temperature above about 450° F. at a pressure high enough to keep the produced liquid substantially free of steam and near to, but less than high enough to damage the reservoir.

10 Claims, 10 Drawing Figures

THERMAL DRAINAGE PROCESS

EAST CAT CANYON DOWNDIP

VISCOSITY-TEMPERATURE CHARTS

FIG. 4 EAST CAT CANYON UPDIP
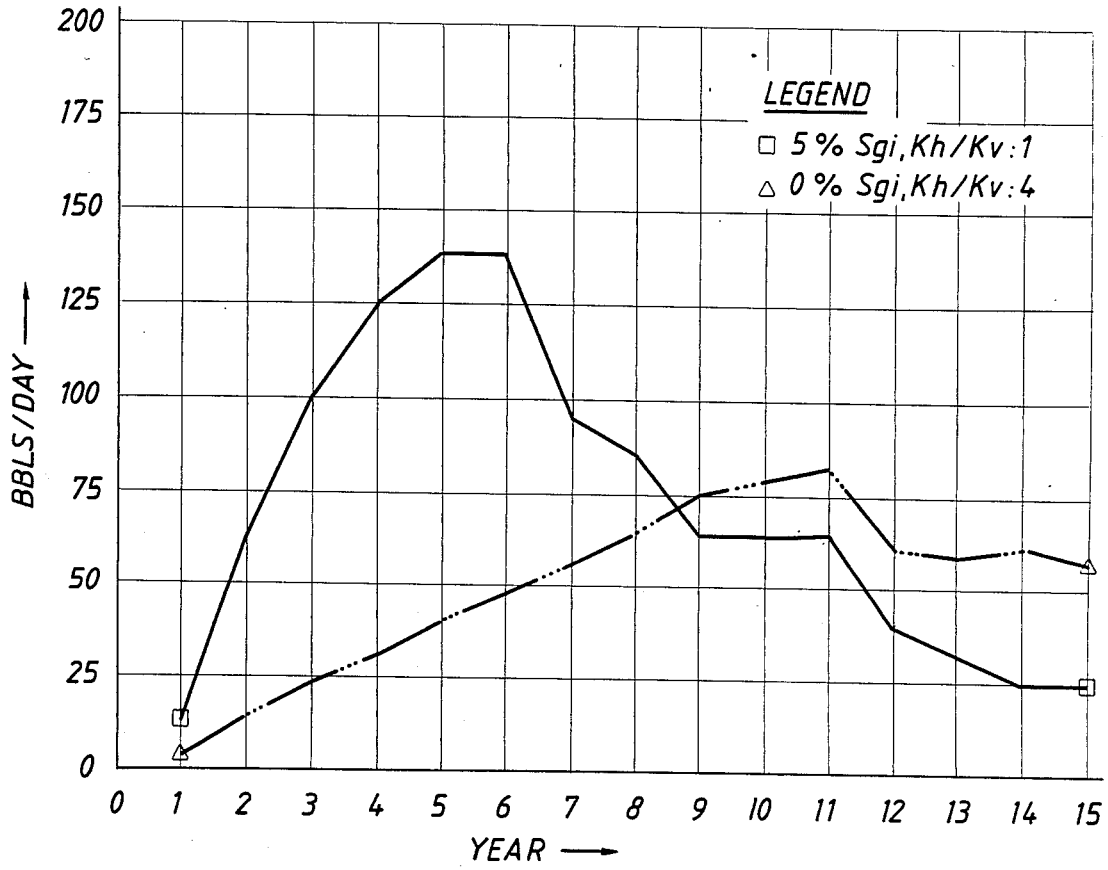
FIG. 5 OXNARD
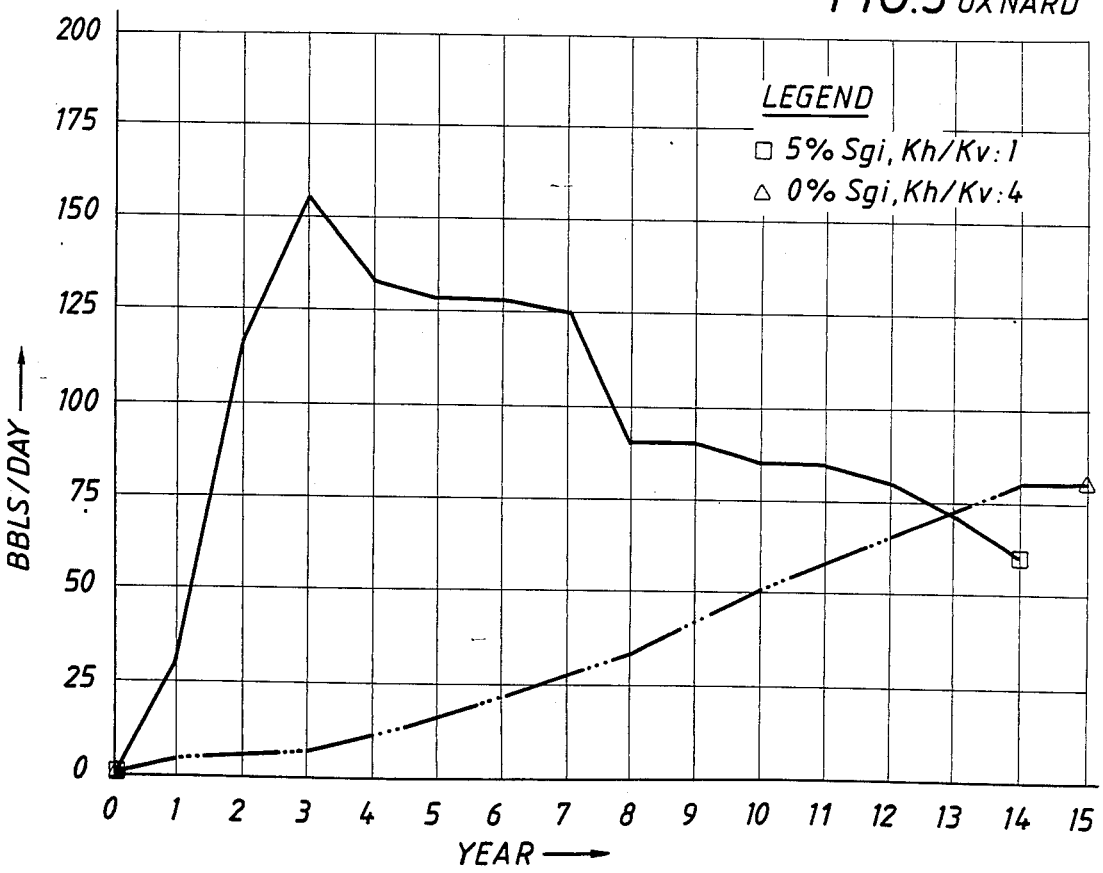

EAST CAT CANYON DOWNDIP

EAST CAT CANYON UPDIP

OXNARD

FIG.9 EAST CAT CANYON DOWNDIP. OIL PRODUCTION RATES WITH WATER DISSOLVING IN THE OIL PHASE.
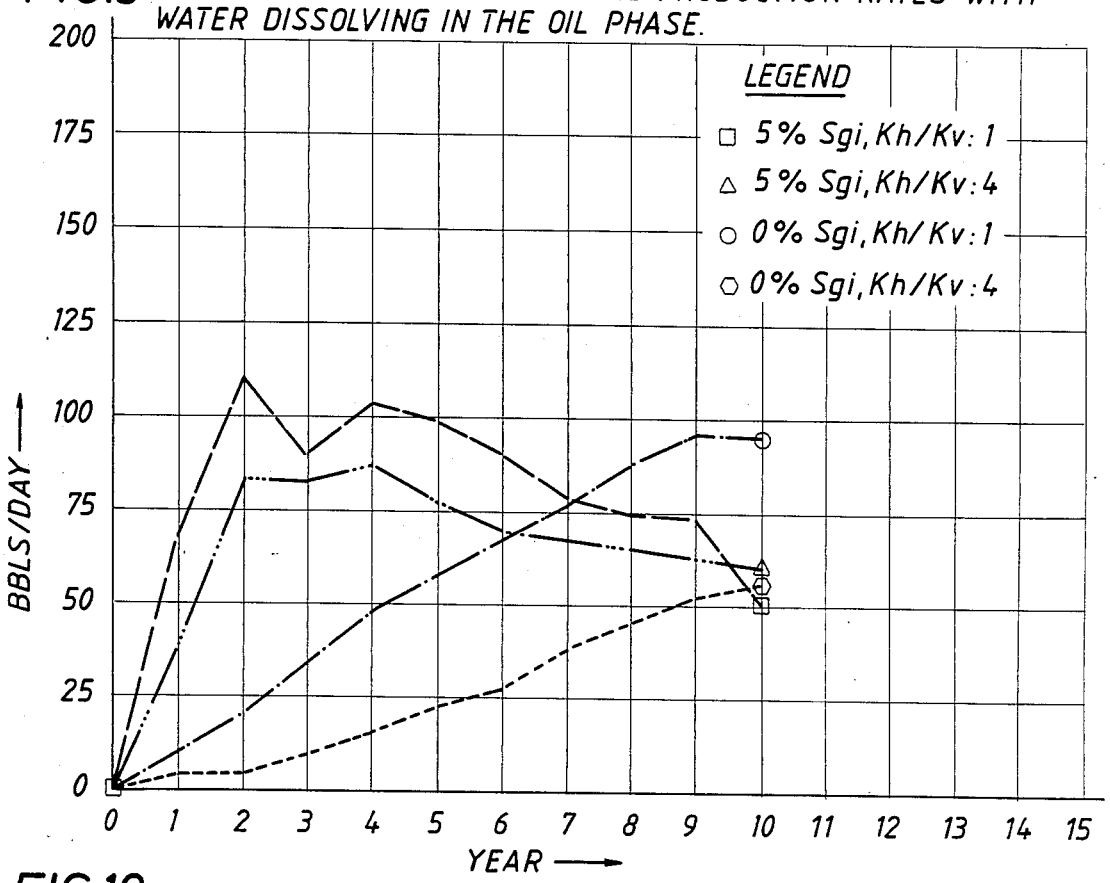
FIG.10 EAST CAT CANYON DOWN DIP. EFFECT OF WATER DISSOLUTION ON OIL PRODUCTION RATES.
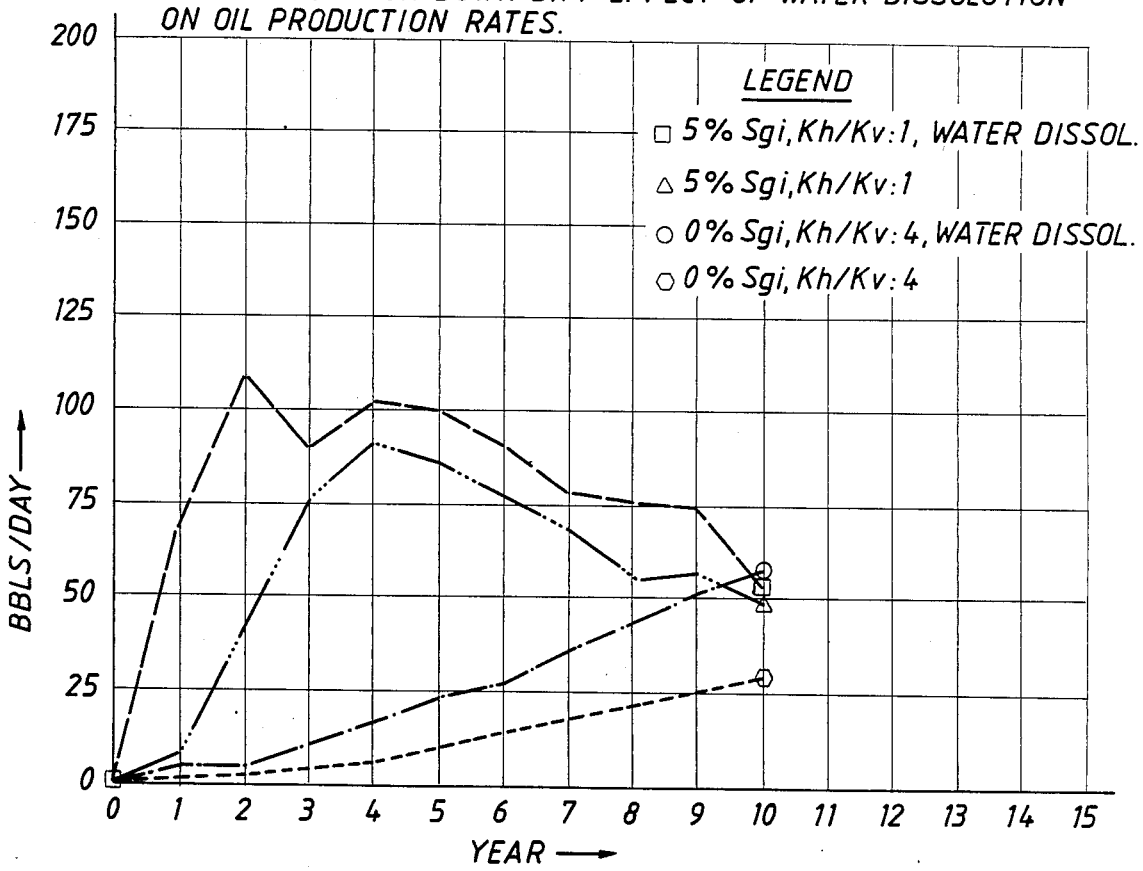

THERMAL DRAINAGE PROCESS FOR RECOVERING HOT WATER-SWOLLEN OIL FROM A THICK TAR SAND

BACKGROUND OF THE INVENTION

The present invention relates to recovering hydrocarbons from a subterranean reservoir which contains tar or very viscous oil and is relatively deeply buried. More particularly, the invention provides an improved process for recovering hydrocarbons from a reservoir having a high permeability, but a low fluid mobility, due to a high concentration of tar or viscous oil which is substantially immobile at the reservoir temperature.

In the following, the term "tar" is used to refer to viscous hydrocarbons which may contain gas and/or water, and which, at the temperature of a subterranean reservoir containing them, are substantially immobile.

In at least two locations in the world tremendously large heavy hydrocarbon accumulations are known to exist in relatively highly permeable formations: vis. the Athabasca tar sands in Canada and the Orinoco (Faja) tar sands in Venezuela. At present these hydrocarbons are not produced commercially. In Venezuela, existing producing capacity of lighter, more valuable crude oil already exceeds demand. In the Athabasca tar sands, the reservoir temperature is so low as to reduce the in situ formation fluid mobility to zero (for all practical purposes). The resulting low injectivity prevents application of previously known thermal recovery processes.

Numerous processes have been proposed for recovering relatively immobile oil from subterranean reservoirs, for example, in patents such as the following: U.S. Pat. No. 1,150,655 suggests using an electrical heater in an open borehole in a deposit of carbonaceous minerals for vaporizing and collecting volatile hydrocarbons. U.S. Pat. No. 3,583,488 suggests increasing the uniformity at which steam is injected into a reservoir by uniformly elevating the temperature of a liner to about the steam injection temperature before the steam is injected through the liner. U.S. Pat. No. 3,739,852 suggests heating an oil reservoir by initially injecting steam into the reservoir at less than fracturing pressure, then fracturing the reservoir by injecting steam at a pressure greater than the fracturing pressure, thus forming a fractured and steam-heated zone which is relatively cylindrical, for use in recovering oil by backflowing fluid from that zone. U.S. Pat. No. 3,993,155 suggests improving a process for recovering viscous oil from a reservoir which will not readily accept direct steam injection by initially injecting steam into a well opened into the reservoir while simultaneously outflowing and venting fluid from near the well bottom in a manner such that the injected fluid sweeps any condensed liquid from the well bore, continuing this until the injected steam will enter the reservoir at a reasonable rate without fracturing the reservoir, injecting steam directly into the so heated reservoir, without the simultaneous fluid production, and subsequently recovering oil by backflowing fluid from the reservoir. A series of U.S. Pat. Nos. 4,008,765; 4,019,575 and 4,120,357 relate to processes for preheating reservoir formations around substantially vertical wells by circulating steam through closed loop flow paths which extend to near the bottom of the wells, producing fluid from below the closed loop flow paths and injecting fluid from adjacent wells arranged for driving oil toward the bottom of the wells containing the closed loop flow paths and recovering oil from the produced fluid.

SUMMARY OF THE INVENTION

Steam at a temperature of at least about 450° F. is injected into contact with an upper portion of a vertical interval of tar-containing subterranean reservoir formation so that the injected steam contacts portions of the reservoir along substantially all of the vertical interval. Liquid is concurrently produced from at least one lower portion of the reservoir interval. The rate and pressure at which the steam is injected and the liquid is produced are arranged so that the produced liquid is substantially steam-free, has a temperature near that of the injected steam, and contains water-swollen oil from which relatively small amounts of the light hydrocarbons have been removed, with the pressure of the injected steam being kept between about 425 psi and a higher pressure apt to damage the reservoir.

BRIEF DESCRIPTION OF THE DRAWING

FIGS. 3–10 are graphs showing the effects, on the average daily oil production rate, of the indicated factors relating to the operation of the present process.

DESCRIPTION OF THE INVENTION

Figure 1:
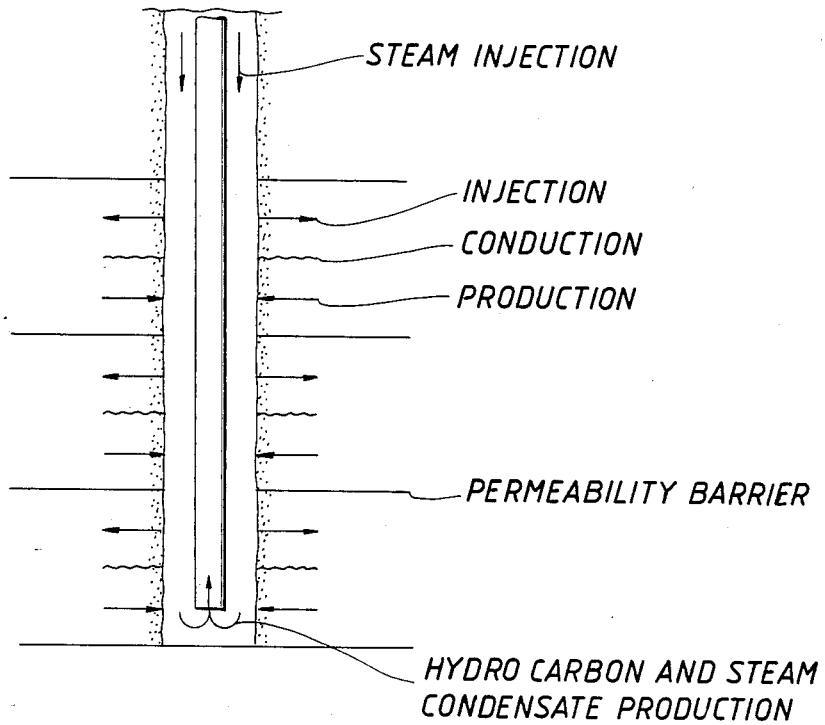
FIG. 1 is a schematic illustration of a reservoir formation in which the present process is being employed.

The present process can be carried out in a single vertical or slanting well which penetrates a tar-containing formation from substantially top to bottom and/or a pattern of such wells. Facilities should be available in each well for, at least initially, injecting steam near the top of the oil bearing interval and producing fluids from near its bottom. Opposite the tar-containing interval, at least initially, each wellbore should be open to injection and/or production over substantially all of that interval. Each wellbore should be initially free of packers or other obstructions to fluid flow; in other words there should be a direct flow path between the points of injection and production inside the well as shown in FIG. 1.

In each well into which steam is injected the liquid production must be restricted to prevent the production of live steam. The injection and production rates should be controlled in such a way that the pressure level in the well stays as high as possible, but preferably stays below fracturing or other reservoir-damaging pressure. A significant fraction of the heat injected during this phase of the process may be transmitted away from the well by means of thermal conduction from the wellbore into the formation. This heat is supplied by the latent heat of steam condensing within the wellbore, and the steam condensate is produced from the bottom of the well at such a rate that no live steam escapes. As known, much of the heat of a produced condensate can be recycled. The pressure at the bottom of the well is only slightly higher than at the top; the difference being the weight of a column of live steam (possibly mixed with some hydrocarbon gas) having a height equal to the thickness of the tar-containing interval.

With time, the formation surrounding the well becomes warmer and the tar is thermally mobilized. Under the influence of gravity the mobilized hot tar will flow into the wellbore where it is subsequently produced along with the steam condensate. In the reservoir the mobilized hot tar is replaced by injected steam and thermally expanded fluids still in the formation. In this way steam injection occurs in the sense that a growing steam blanket develops near the top of the tar-containing interval and/or near the top of each separate interval of the reservoir.

When the formation temperature around the well rises further and approaches steam temperature, the injection of heat by means of thermal conduction declines and convective heat injection becomes dominant. A steam chest will thus grow around the well until it touches the steam chests from the surrounding wells. When this is imminent, the operator can either continue producing in the single well mode or switch to a pattern steam drive in which the steam is injected into some wells while the liquid is produced from near the bottom of other wells. Where the process is to be used as a pattern steam drive process, well spacings of about 2 to 5 acres per well between the open intervals of adjoining wells are particularly suitable.

COMPARISON WITH STEAM DRIVE PROCESSES

In the more successful prior steam drives, it is generally observed that steam has a tendency to override the oil and steam condensate bank. After breakthrough a steam cone forms around the production well and, because the steam mobility is far greater than the oil mobility, the pressure difference between the injection and production wells becomes quite small and is mainly concentrated around the steam injection wells. Gravity thus becomes the major driving force to carry the oil from the reservoir into the production well. The rate at which this oil is produced is determined by the oil mobility, i.e. its viscosity and the permeability of the formation.

In reservoirs containing intermediately heavy oil, the prior steam drives are customarily carried out by maintaining the lowest feasible pressure in the production locations. This policy increases the volume of the flowing steam and thus maximizes the size of the pressure gradient it generates. It also minimizes the process temperature, reducing heat requirements. As a consequence of this policy, however, a significant fraction of the light ends of the hydrocarbon phase will evaporate and be transferred to the vapor phase, increasing the viscosity of the liquid hydrocarbon phase and therefore reducing its mobility, especially in the neighborhood of the production wells.

In the present thermal drainage process, on the other hand, a high pressure is maintained at both the injection and production locations and the process is conducted at high temperature levels. This, and the fact that the present process can be initially carried out in a single well mode, provides advantageous effects on its performance, for example:

(1) The light ends will be kept substantially in the liquid hydrocarbon phase since, at least in relatively deep tar sands, the process pressure can be relatively close to the convergence pressure (i.e. the pressure at which the gas phase partition coefficients of volatile components converge to a common value of 1) and thus, for the temperature involved, about the maximum amount possible of the volatile components are kept in the liquid phase of the oil. Therefore, the liquid viscosity of the oil will be lower than if more of the light ends were removed.

(2) Water dissolves in the liquid hydrocarbon phase and this further reduces the tar viscosity.

(3) At the temperatures employed in the present process mild thermal conversion (i.e., low temperature cracking) of the heavy fractions of the hydrocarbon will convert the hydrocarbon molecules in a way that reduces the oil viscosity and also upgrades the oil.

(4) A significant fraction of the injected heat will be produced at a surface location along with the steam condensate and the hydrocarbons. Because of the high production temperature (essentially the same as the injection temperature) it is easier to recover a substantial fraction of this heat.

(5) Since, in the present process, every well in the field will be a producer, this process will have twice as many producers as an equivalent steam drive drilled on the same spacing.

However, due to the fact that both pressure and temperature are kept high in the present process there can be some negative consequences, for example:

(1) The higher process temperature will cause an increased heat consumption in the oil bearing formation as well as higher heat losses to cap and base rock, particularly where the tar-containing interval is relatively thin.

(2) The wells may be expected to be somewhat more expensive than those used in a conventional steam drive.

But, in general, the advantages of the present process will outweigh the disadvantages in relatively thick oil reservoirs with a very low cold oil mobility. A conventional steam drive utilizing low production pressures might be more economical in a thinner reservoir in which cold oil mobility is relatively high.

PREFERRED RESERVOIR PROPERTIES

In preferred applications, the present thermal drainage process is particularly well suited for highly permeable tar sands. In order to keep heat losses to cap and base rock within reasonable limits and prevent excessive heat consumption in the formation proper, the product of porosity, initial oil saturation and net/gross sand thickness should be relatively high. In addition, the vertical permeability of the formation and the vertical intervals between impermeable shale breaks should be sufficiently thick for the occurrence of gravity drainage from such intermediate intervals.

As might be expected, it is impossible to give exact limiting values for the various reservoir parameters required for successful application of thermal drainage because of interdependent between parameters as well as incomplete understanding of the process at the present time. To give some idea of the kind of reservoirs which are preferred the following list of reservoir properties is indicative.

Minimum reservoir depth - 500 to 1,000 feet
Minimum gross reservoir thickness - 100 feet
Minimum interval thickness between horizontal permeability barriers - 30 feet; if any are present.
Minimum oil viscosity at original reservoir conditions - 1,000 cP
Minimum horizontal formation permeability - 1 Darcy
Minimum vertical formation permeability - 0.1 Darcy Reservoirs typical of those which fall within the above described category are:

Oxnard tar sand in California
East Cat Canyon tar sands also in California
The deeper parts of the Athabasca tar sands in Canada

PVT AND TRANSPORT PROPERTIES

In mathematical simulations of the present process, fluid properties of the tar have been assumed to be similar to those used in previous Peace River studies. The hydrocarbon phase is broken down into two pseudo-components: (a) a dead oil fraction with a molecular weight of 754 and (b) a solution gas containing fraction with a molecular weight of 118.

Figure 2:
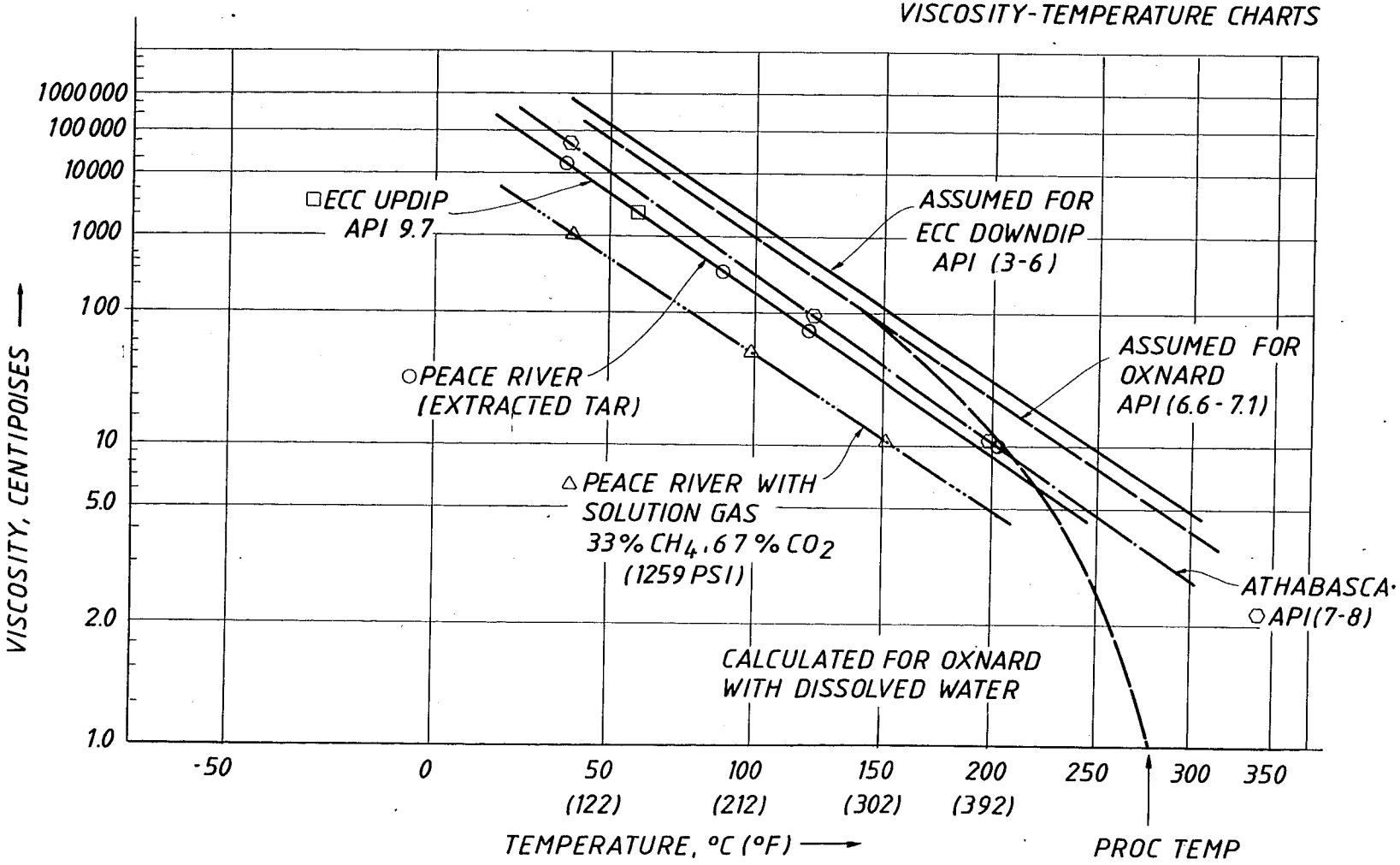
FIG. 2 is a graph of viscosity changes with temperature for different tars.

Estimated tar viscosities are plotted in FIG. 2. For reference purposes, Peace River and Athabasca data are included.

IN SITU ALTERATION OF THE TAR

The susceptibility of tars and heavy crudes to alteration at relatively low temperature levels has been observed in laboratory experiments. The reported density and viscosity reductions under laboratory conditions have been obtained at temperature levels which are obviously higher than expected for the present process. On the other hand the length of the time of exposure to elevated temperatures can be expected to be appreciably longer in the field than in the laboratory experiments described above. To a certain extent these two effects will balance; it is therefore reasonable to expect that we may observe a significant degree of upgrading during the course of our process.

TABLE 1

Effect of Heat Soaking on Physical Properties of Athabasca Tar
Temperature 662° F., Duration 24 hours
(From: Erdman, J.G. and Dickie, J.P., Presentation at ACS Division of Petroleum Chemistry, Philadelphia, PA., April 5-10, 1964)

| Property | Unheated | Heated |
|---|---|---|
| Density at 60° F., g/cc | 1.016 | 0.9712 |
| Gravity, °API | 5.4 | 11.7 |
| Viscosity, Centistokes | | |
| at 68° F. | too viscous | 866 |
| at 100° F. | 33,870 | 221 |
| at 130° F. | 5,512 | 83.5 |

DESCRIPTION OF NUMERICAL MODEL

In order to predict the performance of the reservoir when produced according to the present process we have modeled the single well process with a two dimensional grid of 22 radial blocks by 10 vertical layers. The central column of the grid represents the wellbore. Steam is injected at the top and fluids draining from the formation are produced at the bottom. A logarithmic scale is used near the well to size the grid blocks, while farther away the grid blocks dimensions are represented by constant radial increments. The outer radius of the drainage area is 186 feet, corresponding to 2.5 acre well spacing.

PROTOTYPE DESCRIPTION

We have simulated the performance of three potential candidates for the thermal drainage process: (a) East Cat Canyon Downdip Brooks Sand (3°-6° API) (b) East Cat Canyon Updip Brooks Dand (9°-11° API) and (c) Oxnard Vaca Sand (6.5°-7.5° API). For these three prototypes we have evaluated the performance for different conditions. Since initial injectivity may have a significant effect on the early time well productivity we have calculated the process performance for two conditoins each, vis. low and high initial steam injectivity. The conservative case of low initial steam injectivity has been modeled by assuming that the formation is originally completely liquid saturated and that the ratio of horizontal to vertical permeability (kh/kv) is equal to 4. For the more optimistic case the ratio of horizontal to vertical permeability was taken equal to 1, while high initial injectivity was obtained by assuming a gas saturation (Sgi) of 5% at the beginning of the process.

The effect of water dissolved in the oil phase on its viscosity has been evaluated only for the East Cat Canyon Downdip case.

At this time we do not have sufficient information on the effect of mild thermal conversion on the viscosity of the oil phase. Indications are that the effect is significant so that the results presented here are conservative.

Table 2 presents the parameter values used in the simulations of thermal drainage in the three above mentioned prototypes. The initial steam injectivity has been increased in some of the runs by assuming an initial gas saturation of 5%. The corresponding oil saturation in those cases has been reduced from 75% to 70%.

TABLE 2

| | ECC Downdip | ECC Updip | Oxnard |
|---|---|---|---|
| Depth (ft) | 3,200 | 3,200 | 2,000 |
| Reservoir thickness (ft) | 140 | 180 | 300 |
| Porosity (%) | 29 | 29 | 35 |
| Horizontal permeability (mD) | 1,367 | 1,367 | 2,000 |
| Oil viscosity (cP) at initial | 62,700 | 2,365 | 62,000 |
| reservoir temperature (°F.) | (135) | (135) | (122) |
| Number of grid blocks (r × z) | 22 × 8 | 22 × 8 | 22 × 12 |
| Thickness (ft)/grid layer | 17.5 | 22.5 | 25 |
| Drainage area (acres) | 2.5 | 2.5 | 2.5 |

These parameter values are somewhat arbitrary but reasonable as guidelines for representative cases. As will be discussed below, some other factors may shift the results of the low and the high injectivity cases, but their relative significance will be preserved.

RESULTS

Figure 3:
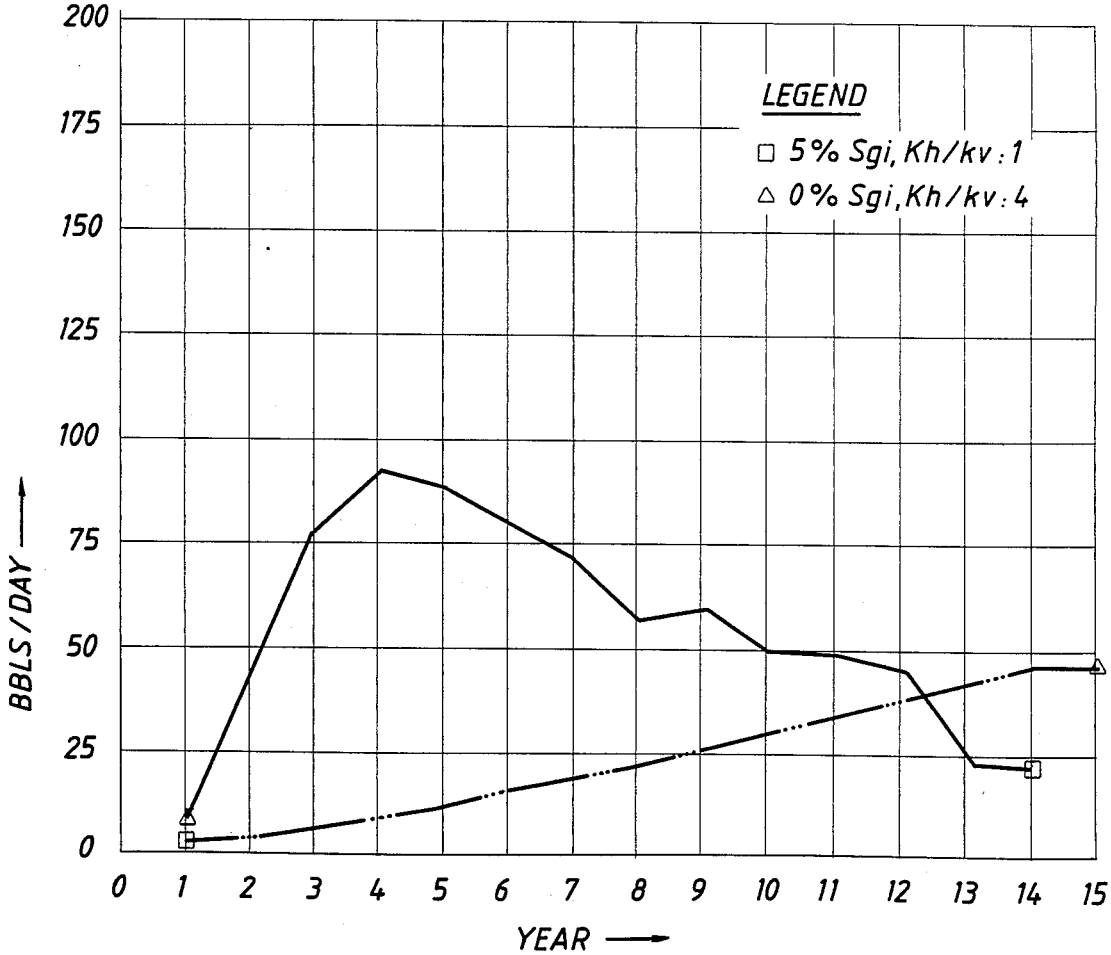
Figure 6:
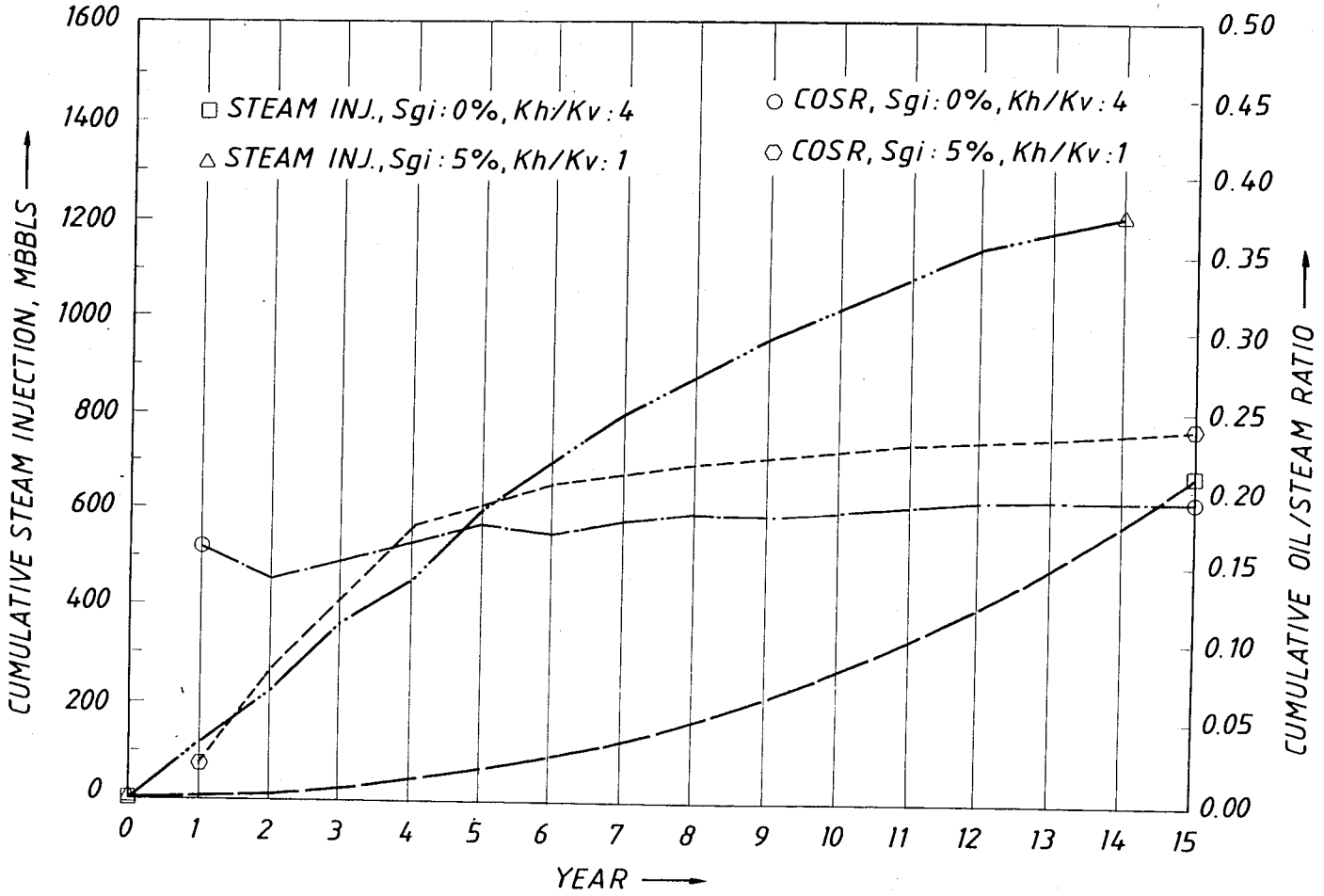
Figure 7:
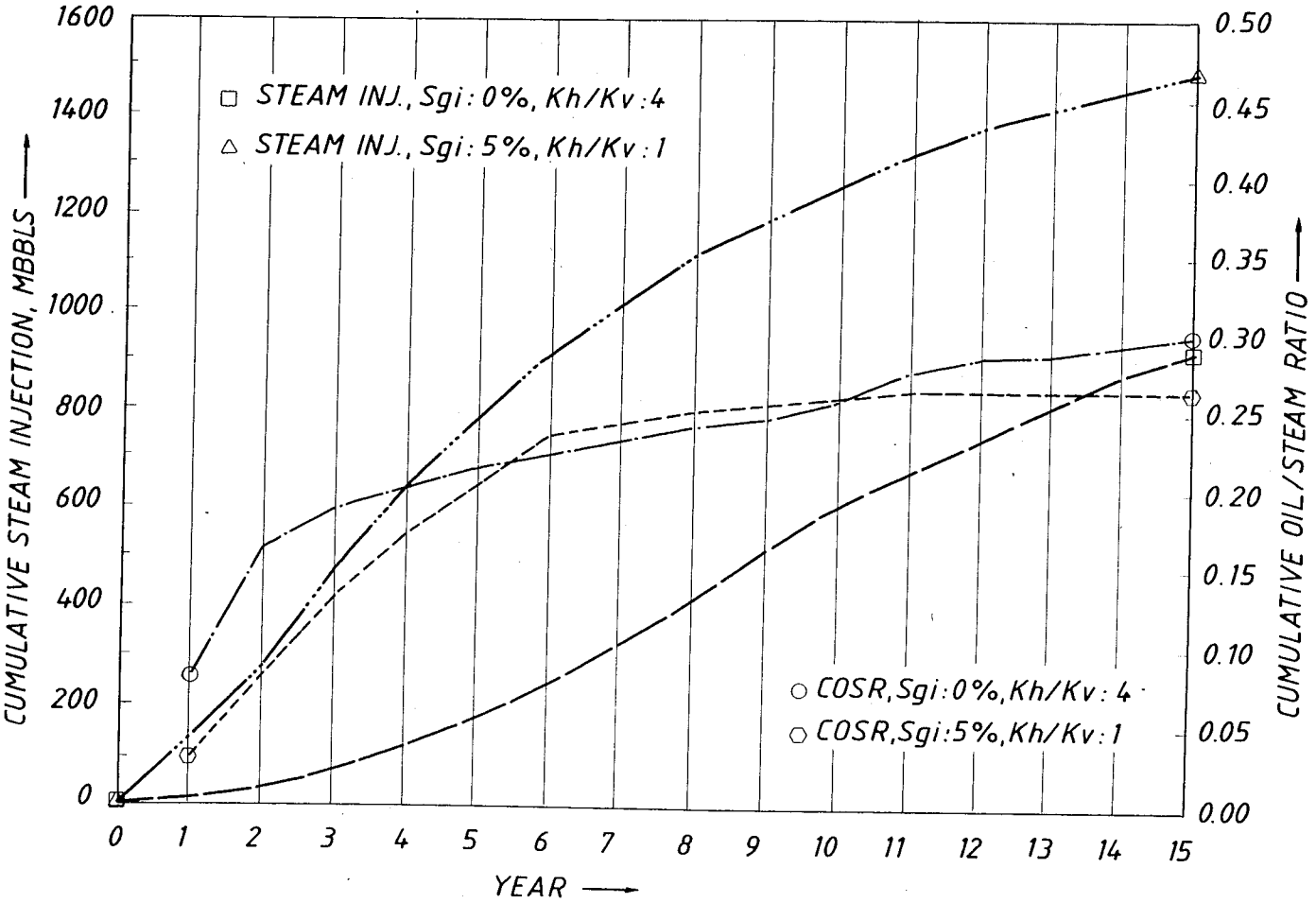
Figure 8:
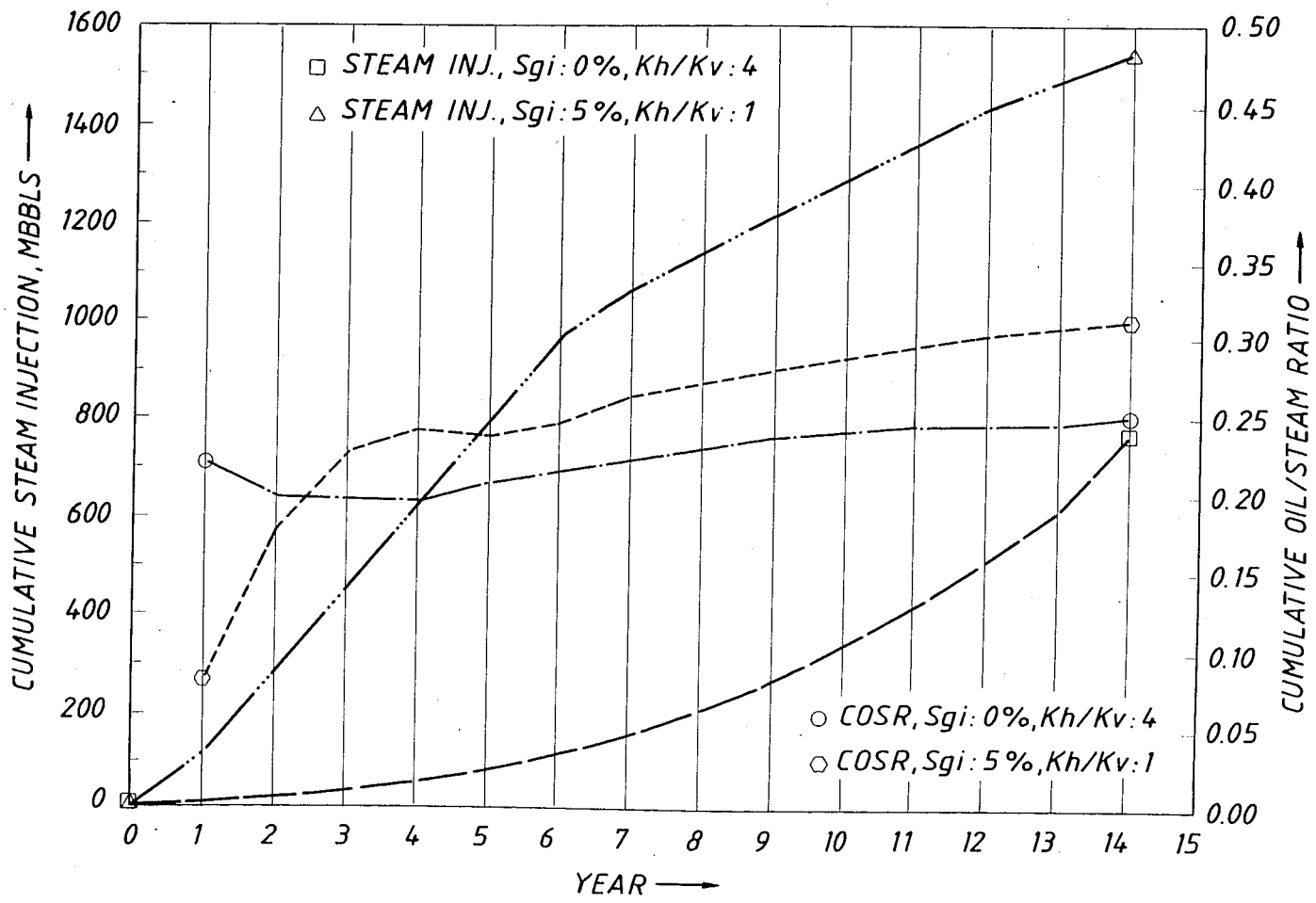

Oil production rates for low and high injectivity runs for East Cat Canyon Downdip, East Cat Canyon Updip and Oxnard are presented in FIGS. 3, 4 and 5. Cumulative steam injection and cumulative oil/steam ratios for these cases are shown in FIGS. 6, 7 and 8. Steam rates refer to a 100% steam quality at the sand face.

For the liquid filled cases, heating by thermal conduction and subsequent gravity drainage is the only mechanism considered to create injectivity. In contrast, in the 5% initial gas saturation runs, steam injectivity is significantly enhanced by the dissolution of the hydrocarbon gas. This causes the early formation of a hot oil-water layer draining into the well.

For the much more viscous tars of the Downdip East Cat Canyon and Oxnard, only the high injectivity runs (5% Sgi) show a distinct peak in the production rate (FIGS. 6 and 7). In the lower injectivity cases, the steam chest barely reaches the outer boundary after 14 years.

The Table below shows the cumulative oil/steam ratios and oil recovery after 14 years. Also included are peak oil rates and response times. They were obtained from the S-shaped cumulative production curves as the slope and intercept of the tangent at the inflexion points.

TABLE 3

| | COSR 14th year | % OOIP Recovered 14th year | Peak Oil Response Rate BBl/d | Peak Oil Response Time Years |
|---|---|---|---|---|
| East Cat Canyon Downdip | | | | |
| low injectivity | .19 | 21 | 45 | 8.00 |
| high injectivity | .24 | 48 | 91 | 1.5 |
| East Cat Canyon Updip | | | | |
| low injectivity | .29 | 37 | 76 | 4.10 |
| high injectivity | .27 | 52 | 137 | 1.75 |
| Oxnard* | | | | |
| low injectivity | .25 | 13 | 86 | 7.0 |
| high injectivity | .31 | 32 | 129 | 1.0 |

*Run for 10 years and extrapolated to 14.

The contrast between the high and low injectivity cases emphasizes the sensitivity of the production forecast to initial conditions and vertical permeability.

The oil/steam ratios reported above are based on a 100% steam quality at the sand face. Two opposite facts, not included in the calculations, will affect their values: (1) the actual downhole steam quality and (2) the recovery of heat produced at the surface, which amounts to more than 40% of the heat injected.

As mentioned above, one of the potential benefits of operating at high temperature is water dissolution in the hydrocarbon phase. Water acting as a low viscosity solvent will significantly affect the tar viscosity.

Water solubility data is available for aromatic and paraffinic fractions as a function of temperature.

An estimation of the viscosity reduction that can be expected due to dissolved water is shown in FIG. 2 for the Oxnard crude.

Oil production rates for the East Cat Canyon Downdip case with water dissolving in the oil phase are shown in FIG. 9. It is apparent that the impact of vertical permeability becomes more pronounced as the steam injectivity is reduced. We have also found that for a much less viscous oil (0.4 cp at process temperature) with a much higher injectivity the effect of cutting the ratio from to 0.5 to 0.125 becomes insignificant after 4 years.

Finally, FIG. 10 compares Downdip East Cat Canyon runs with and without water solubility to illustrate the impact of the viscosity reduction effect.

This effect becomes significant at temperatures above 450° F. and may be very important at oil temperatures of 550° F. Numerical dispersion in the simulations suppresses the water dissolution effect. Measured oil viscosities at high temperatures with and without water present would be very useful in history matching any field test of this process.

Although viscosity reduction due to mild thermal conversion has not been included in this study, its role should also become significant as the process temperature is increased.

As will be apparent to those skilled in the art, wells completed in highly permeable, viscous oil reservoirs are apt to be opened into essentially unconsolidated formations. In such situations sand control measures, such as those currently known and available, should be utilized to prevent the inflow of sand into the wells.

Similarly, methods and devices such as those currently known or available should be utilized to insulate the steam inflow and produced fluid outflow tubing strings, in order to reduce losses of heat. In a preferred embodiment, the fluid produced from near the bottom of the open interval of the well being treated should be substantially completely liquid and should have the bottomhole temperature which is near to, but slightly less than, that of the inflowing steam. Methods and devices such as those currently conventional can advantageously be utilized to capture and recirculate the heat from this fluid. For example, such heat can be utilized to heat the feed water for the steam generators, and the like.

In a preferred embodiment of the invention, a telemetering temperature measuring device can be arranged to monitor the bottomhole temperature of the fluid being produced. Such a device can readily be arranged to automatically adjust the backpressuring of the fluid being produced, and/or rate of steam being injected, in order to maintain the pressure within the open interval of the well at near to, but less than, a pressure which might damage the reservoir.

In general, the steam used in the present process can be substantially any low quality, dry, or superheated, steam. Dry steam is preferred, with the steam being generated at a surface location and conveyed into the open interval of the well with substantially as little as possible condensation.

What is claimed is:

1. A process for recovering oil from a subterranean tar-containing reservoir formation, comprising:

injecting steam into at least one well having a wellbore which is equipped to provide a direct flow path between the point of steam entry and a point near the bottom of the wellbore from which fluid is produced as well as the face of the reservoir formation substantially all along a substantially vertical interval of the reservoir formation;

injecting said steam at a temperature of at least about 450° F. which is high enough to effect a thermal upgrading of the tar within the reservoir formation;

producing liquid from said point near the bottom of the wellbore; and arranging the rate and pressure at which the steam is injected and the liquid is produced so that the produced liquid is substantially free of steam and, within the well and along said interval of reservoir formation, the pressure is sufficiently near to the convergence pressure to reduce the viscosity of the oil being produced by keeping light ends of the oil in liquid phase and the temperature is high enough to reduce the viscosity of the oil by the swelling action of water dissolved in the oil, without the pressure being high enough to damage the reservoir.

2. The process of claim 1 in which the viscous oil reservoir formation is a tar sand.

3. The process of claim 1 in which a plurality of wells are utilized in a well pattern providing spacings of about 2 to 5 acres/well between the open intervals of adjoining wells.

4. The process of claim 1 in which the injected steam and produced fluid are conveyed into and out of the well in thermally insulated conduits.

5. The process of claim 4 in which the heat of the produced fluid is recovered and utilized at the surface location.

6. The process of claim 1 in which the temperature of the produced liquid is kept at about 25° F. lower than that of the injected steam.

7. The process of claim 6 in which the bottomhole temperature is monitored by a telemetering means arranged for automatically adjusting the liquid production pressure to maintain said temperature.

8. The process of claim 1 in which the injected steam is dry steam.

9. The process of claim 1 in which the pressure of the produced liquid is relatively close to the convergence pressure for the temperature of that liquid.

10. The process of claim 1 in which a pattern of wells are employed and, when the touching of the steam chests around adjacent wells is about imminent, at least a portion of such wells are utilized only for producing liquid from near the bottom of the reservoir interval.

* * * * *